US011624996B2

(12) United States Patent
Komori et al.

(10) Patent No.: US 11,624,996 B2
(45) Date of Patent: Apr. 11, 2023

(54) IMAGE FORMING APPARATUS HAVING DETERIORATION QUANTITY OF PHOTOSENSITIVE DRUM DETERMINING CAPABILITY

(71) Applicant: BROTHER KOGYO KABUSHIKI KAISHA, Nagoya (JP)

(72) Inventors: Ayaka Komori, Nagoya (JP); Shintaro Suzuki, Nagoya (JP); Sota Hirano, Kasugai (JP); Kazuma Hinoue, Nagoya (JP); Marika Ozaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/482,584

(22) Filed: Sep. 23, 2021

(65) Prior Publication Data

US 2022/0091553 A1 Mar. 24, 2022

(30) Foreign Application Priority Data

Sep. 24, 2020 (JP) ..... JP2020-159358
Sep. 24, 2020 (JP) ..... JP2020-159360

(51) Int. Cl.
*G03G 15/00* (2006.01)

(52) U.S. Cl.
CPC ..... *G03G 15/553* (2013.01); *G03G 15/757* (2013.01)

(58) Field of Classification Search
None
See application file for complete search history.

(56) References Cited

U.S. PATENT DOCUMENTS

2006/0025967 A1 2/2006 Furno et al.
2007/0122167 A1 5/2007 Sugiyama et al.
2014/0016953 A1* 1/2014 Yoshida ..... G03G 15/5033 399/26
2017/0184999 A1* 6/2017 Jung ..... G03G 15/0865

FOREIGN PATENT DOCUMENTS

JP 9-244413 A 9/1997
JP 10-161485 A 6/1998
JP 2003-323090 A 11/2003
JP 2005-128150 A 5/2005

(Continued)

*Primary Examiner* — Sevan A Aydin
(74) *Attorney, Agent, or Firm* — Merchant & Gould P.C.

(57) ABSTRACT

An image forming apparatus including a motor, a photosensitive drum, a developing roller, a main memory, and a controller. The controller is configured to perform storing a first rotation number and a second rotation number in the main memory. The first rotation number is the rotation number of the photosensitive drum rotated in a first state where the photosensitive drum rotates and the developing roller is stopped. The second rotation number is the rotation number of the photosensitive drum rotated in a second state where the photosensitive drum rotates and the developing roller rotates. The controller is further configured to perform, in a case where the photosensitive drum rotates, determining a total deterioration quantity of the photosensitive drum which is a cumulative deterioration quantity of the photosensitive drum based on the first rotation number and the second rotation number.

28 Claims, 6 Drawing Sheets

(56) References Cited

FOREIGN PATENT DOCUMENTS

| | | | |
|---|---|---|---|
| JP | 2006-84828 | A | 3/2006 |
| JP | 2007-155756 | A | 6/2007 |
| JP | 2007-187734 | A | 7/2007 |
| JP | 2008-508555 | A | 3/2008 |
| JP | 2013-50601 | A | 3/2013 |

* cited by examiner

IMAGE FORMING APPARATUS HAVING DETERIORATION QUANTITY OF PHOTOSENSITIVE DRUM DETERMINING CAPABILITY

CROSS REFERENCE TO RELATED APPLICATION

This application claims priority from Japanese Patent Applications No. 2020-159358 filed Sep. 24, 2020 and No. 2020-159360 filed Sep. 24, 2020. The entire content of each of these priority applications is incorporated herein by reference.

TECHNICAL FIELD

The present disclosure relates to an image forming apparatus including a photosensitive drum and a developing roller.

BACKGROUND

There has been known an image forming apparatus including a photosensitive drum and a developing roller. In the conventional image forming apparatus, a time period for contacting the developing roller with the photosensitive drum in a rotating state of the photosensitive drum is counted. In a case where the time period for contacting the developing roller with the photosensitive drum reaches a threshold value, determination is made that the photosensitive drum reaches the end of its service lifetime due to depletion.

SUMMARY

An image forming apparatus configured to perform rotating and stopping rotation of a photosensitive drum independent of rotating and stopping rotation of a developing roller is conceivable. In such a conceivable image forming apparatus, assumable is one case where the photosensitive drum is rotating while the developing roller is rotating, and another case where the photosensitive drum is rotating while the developing roller stops rotating.

According to the conventional image forming apparatus, deterioration quantity of the photosensitive drum may not be accurately calculated in spite of the counting of the time period for contacting the developing roller with the photosensitive drum in the rotating state of the photosensitive drum, since the deterioration quantity of the photosensitive drum in the above-described one case is different from the deterioration quantity in the above-described another case.

In view of the foregoing, it is an object of the disclosure to provide an accurate calculation of the deterioration quantity of the photosensitive drum.

In order to attain the above and other objects, according to one aspect, the disclosure provides an image forming apparatus including a motor, a photosensitive drum, a first clutch, a developing roller, a second clutch, a main memory, and a controller. The first clutch is configured to transmit a driving force of the motor to the photosensitive drum. The first clutch is switchable between a state for allowing the photosensitive drum to rotate and a state for stopping rotation of the photosensitive drum. The second clutch is configured to transit the driving force of the motor to the developing roller. The second clutch is switchable between a state for allowing the developing roller to rotate and a state for stopping rotation of the developing roller. The controller is configured to perform storing a first rotation number and a second rotation number in the main memory. The first rotation number is the rotation number of the photosensitive drum rotated in a first state where the photosensitive drum rotates and the developing roller is stopped. The second rotation number is the rotation number of the photosensitive drum rotated in a second state where the photosensitive drum rotates and the developing roller rotates. The controller is further configured to perform, in a case where the photosensitive drum rotates, determining a total deterioration quantity of the photosensitive drum which is a cumulative deterioration quantity of the photosensitive drum based on the first rotation number and the second rotation number.

According to another aspect, the disclosure provides a drum cartridge including a photosensitive drum, a developing roller, and a drum memory. The drum memory includes a first storage region and a second storage region. The first storage region stores a first rotation number which is the rotation number of the photosensitive drum rotated in a first state where the photosensitive drum rotates and the developing roller is stopped. The second storage region stores a second rotation number which is the rotation number of the photosensitive drum rotated in a second state where the photosensitive drum rotates and the developing roller rotates.

According to another aspect, the disclosure provides a drum cartridge including a photosensitive, a developing roller and a drum memory. The drum memory stores a deterioration quantity determined based on a first rotation number and a second rotation number. The first rotation number is the rotation number of the photosensitive drum rotated in a first state where the photosensitive drum rotates but the developing roller is stopped. The second rotation number is the rotation number of the photosensitive drum rotated in a second state where the photosensitive drum rotates and the developing roller rotates.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
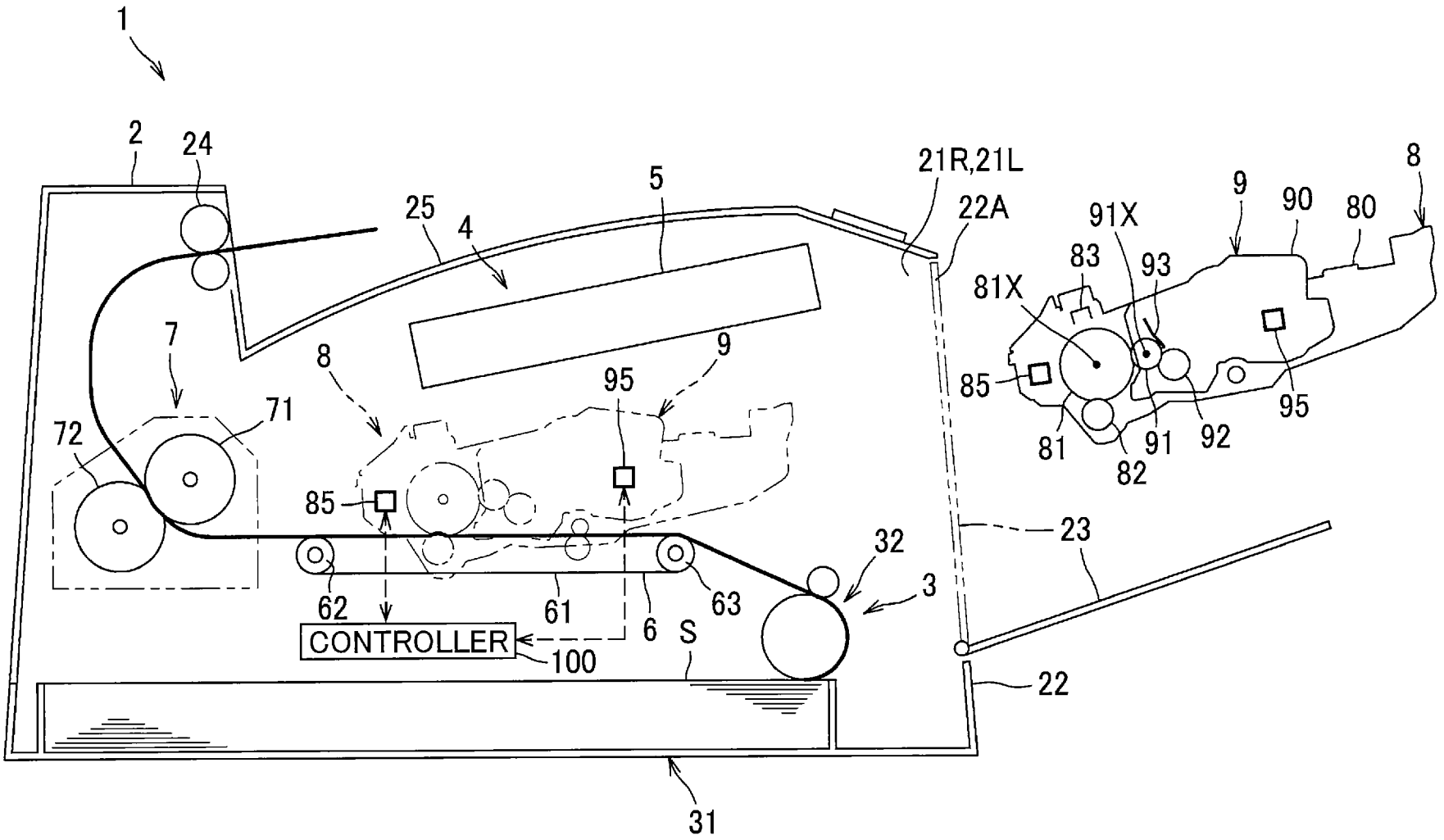
FIG. 1 is a schematic cross-sectional view of an image forming apparatus according to a first embodiment.
Figure 2:
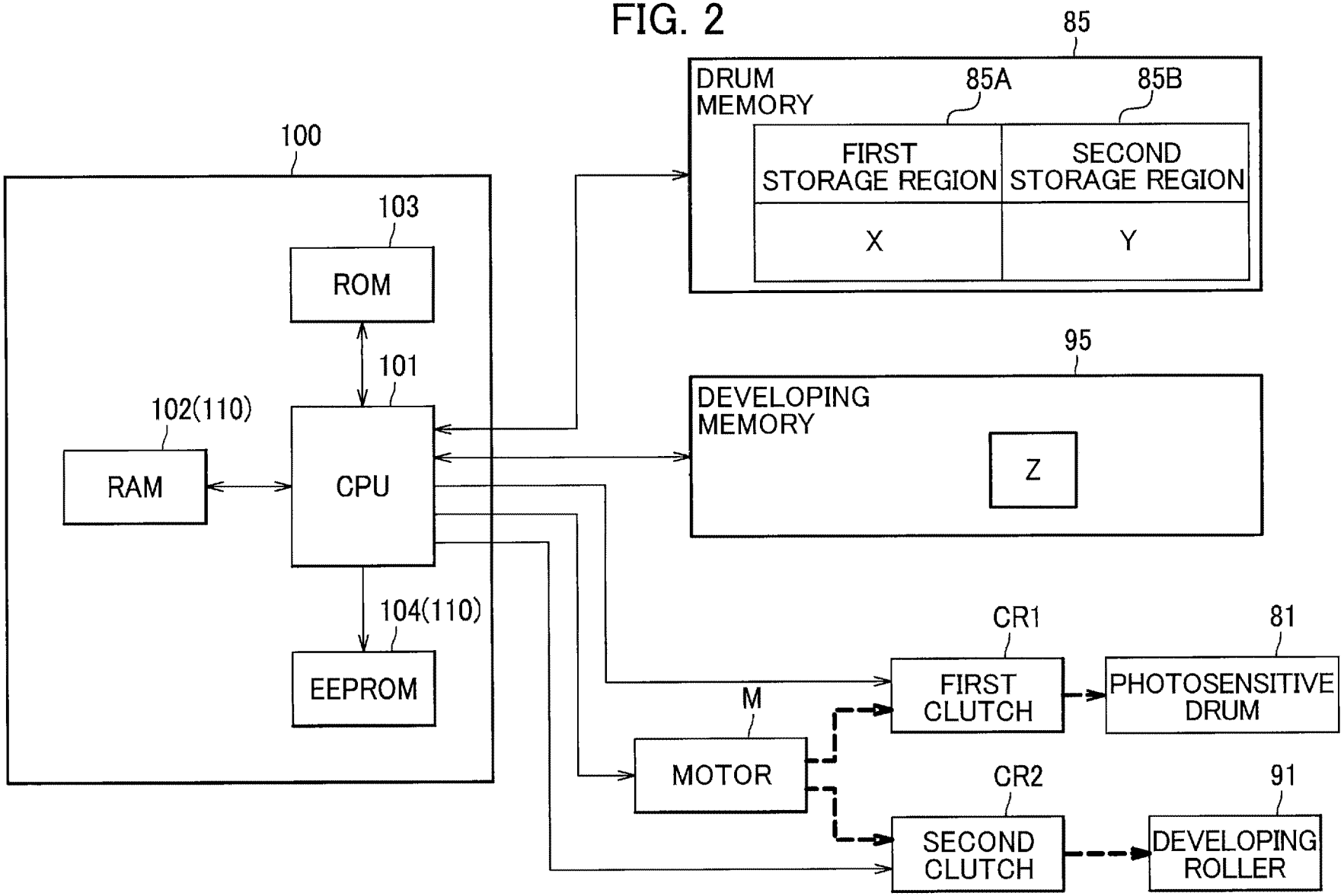
FIG. 2 is a block diagram illustrating an electrical circuit including a controller, a main memory, a drum memory, a developing memory, a motor, and clutches in the image forming apparatus according to the first embodiment.

An image forming apparatus 1 according to a first embodiment of the present disclosure will be described with reference to FIGS. 1 through 4. As illustrated in FIG. 1, the image forming apparatus 1 is a monochromatic laser printer. The image forming apparatus 1 includes a housing 2, a feeder unit 3, an image forming unit 4, a controller 100, and a main memory 110 (FIG. 2).

The housing 2 has a hollow shape. The housing 2 includes side walls 21R, 21L, and a front wall 22 connecting the side walls 21R, 21L together. The front wall 22 has a housing opening 22A. A front cover 23 is provided on the front wall 22 for opening and closing the housing opening 22A.

The feeder unit 3 includes a supply tray 31 and a sheet pick-up mechanism 32. The supply tray 31 is attachable to and detachable from a lower portion of the housing 2. The sheet pick-up mechanism 32 is configured to supply a sheet S in the supply tray 31 toward the image forming unit 4.

The image forming unit 4 includes a scanner unit 5, a belt unit 6, a fixing unit 7, a drum cartridge 8, and a developing cartridge 9.

The scanner unit 5 is positioned at an upper internal portion of the housing 2, and includes a laser emitting portion, a polygon mirror, a lens, and a reflection mirror those not illustrated. The scanner unit 5 is configured to irradiate laser beam at high scanning speed onto a surface of a photosensitive drum 81 described later.

The belt unit 6 includes an endless belt 61, a drive roller 62, and a driven roller 63. The belt unit 6 is detachable from and attachable to the housing 2.

As illustrated in FIG. 2, the controller 100 includes a CPU 101, a RAM 102, a ROM 103, an EEPROM 104, and an input/output circuit. The controller 100 is configured to perform arithmetic processing on a basis of information related to a cartridge attached to the housing 2, programs and data stored in the RAM 102 and the ROM 103 for controlling printing operation. Incidentally, the RAM 102 and the EEPROM 104 are examples of a "main memory 110". Further, the RAM 102 is an example of a "volatile memory", and the EEPROM 104 is an example of a "non-volatile memory". The CPU 101 is electrically connected to the RAM 102, the ROM 103, the EEPROM 104, a drum memory 85 and a developing memory 95 those described later.

Turning back to FIG. 1, the drum cartridge 8 is positioned between the feeder unit 3 and the scanner unit 5. The drum cartridge 8 is attachable to and detachable from the housing 2. Specifically, the drum cartridge 8 is configured to be attached to and detached from the housing 2 through the housing opening 22A opened or closed by the front cover 23.

The drum cartridge 8 is used with the developing cartridge 9 including a developing roller 91. The developing cartridge 9 is attachable to and detachable from the drum cartridge 8. The developing cartridge 9 is attached to the housing 2 in an attached state of the developing cartridge 9 to the drum cartridge 8.

The drum cartridge 8 includes a frame 80, the photosensitive drum 81, a transfer roller 82, a charger 83, and the drum memory 85. The frame 80 is configured to receive the developing cartridge 9. The photosensitive drum 81 and the transfer roller 82 are rotatably supported by the frame 80. The photosensitive drum 81 is rotatable about a first axis 81X extending in an axial direction of the photosensitive drum 81 (hereinafter simply referred to as "axial direction").

The drum memory 85 is a storage medium such as an IC chip configured to store information. However, a storage medium other than the IC chip is available.

The developing cartridge 9 includes a casing 90, the developing roller 91, a supply roller 92, a blade 93, and the developing memory 95. The casing 90 is configured to accommodate therein toner. The developing roller 91 is configured to supply toner to the photosensitive drum 81. The developing roller 91 is rotatable about a second axis 91X extending in the axial direction. The supply roller 92 is configured to supply toner in the casing 90 to the developing roller 91. The blade 93 is configured to regulate a thickness of a toner layer formed on the developing roller 91.

The developing memory 95 is a storage medium such as an IC chip configured to store information. However, a storage medium other than the IC chip is available. The developing memory 95 is an example of a "non-volatile memory".

As illustrated in FIG. 2, the image forming apparatus 1 further includes a motor M, a first clutch CR1, and a second clutch CR2. Incidentally, in FIG. 2, transmission of electrical signals is indicated by a solid line arrow, and transmission of driving force is indicated by a broken line arrow. The motor M is configured to start rotating in response to an instruction from the controller 100.

The first clutch CR1 is configured to transmit the driving force of the motor M to the photosensitive drum 81. The first clutch CR1 is switchable between a state of rotating the photosensitive drum 81 and a state of stopping rotation of the photosensitive drum 81 in response to an instruction from the controller 100.

The second clutch CR2 is configured to transmit the driving force of the motor M to the developing roller 91 in response to an instruction from the controller 100. The second clutch CR2 is switchable between a state of rotating the developing roller 91 and a state of stopping rotation of the developing roller 91.

Specifically, while the motor M is rotating, the photosensitive drum 81 rotates in case of an ON state of the first clutch CR1, and the photosensitive drum 81 is stopped in case of an OFF state of the first clutch CR1. Further, while the motor M is rotating, the developing roller 91 rotates in case of an ON state of the second clutch CR2, and the developing roller 91 is stopped in a case of an OFF state of the second clutch CR2.

Turning back to FIG. 1, in the drum cartridge 8, after the surface of the rotating photosensitive drum 81 is uniformly charged by the charger 83, the surface is exposed to laser beam emitted from the scanner unit 5 at high scanning speed. Hence, an electric potential of the exposed region is lowered to form an electrostatic latent image on a basis of image data on the surface of the photosensitive drum 81.

Then, toner in the developing cartridge 9 is supplied to the electrostatic latent image formed of the photosensitive drum 81 by the developing roller 91 that is rotationally driven to form a toner image on the surface of the photosensitive drum 81. Then, a toner image formed on the surface of the photosensitive drum 81 is transferred onto a sheet S conveyed through a portion between the photosensitive drum 81 and the transfer roller 82.

The fixing unit 7 includes a heat roller 71 and a pressure roller 72. The pressure roller 72 is positioned to face the heat roller 71. The pressure roller 72 is configured to press against the heat roller 71. The toner image transferred onto the sheet S is thermally fixed to the sheet S when the sheet S moves past the heat roller 71 and the pressure roller 72.

The sheet S subjected to thermal fixing by the fixing unit 7 is then conveyed by a conveyer roller 24 and is discharged onto a discharge tray 25 from the conveyer roller 24.

The controller 100 is configured to determine a total deterioration quantity W of the photosensitive drum 81 which is a cumulative deterioration quantity of the photosensitive drum 81 on a basis of a first rotation number and a second rotation number in case of rotation of the photosensitive drum 81. The first rotation number is the rotation number of the photosensitive drum 81 in a first state where the photosensitive drum 81 is rotating and the developing roller 91 stops rotating. The second rotation number is the rotation number of the photosensitive drum 81 in a second state where the photosensitive drum 81 and the developing roller 91 are rotating.

A method for calculating the total deterioration quantity W of the photosensitive drum 81 according to the first embodiment will next be described.

The controller 100 is configured to count the first rotation number and the second rotation number for a predetermined period of time in the rotating state of the photosensitive drum 81. The first rotation number and the second rotation number those being counted for the predetermined period of time are sequentially written in the RAM 102. Hereinafter, the first rotation number and the second rotation number those being counted for the predetermined period of time are referred to as a first rotation number x and a second rotation number y. The predetermined period of time may be a definite period of time, or may be a period for performing print job once, or may be a period of time for rotating the photosensitive drum 81 by a prescribed number of rotations.

As illustrated in FIG. 2, the drum memory 85 includes a first storage region 85A and a second storage region 85B.

The controller 100 is configured to permit the first storage region 85A to store therein the first rotation number. That is, the first storage region 85A stores therein the first rotation number. According to the first embodiment, the first storage region 85A stores therein a first total rotation number X as the first rotation number. The first total rotation number X is a cumulative rotation number of the photosensitive drum 81 which is new photosensitive drum and which is in the first state. That is, in the first storage region 85A, the first rotation number x is added to the first total rotation number X each time the photosensitive drum 81 in the first state rotates once. Incidentally, X=0 is stored in the first storage region 85A in a case where the photosensitive drum 81 is the new drum.

The controller 100 is configured to permit the second storage region 85B to store therein the second rotation number. That is, the second storage region 85B stores therein the second rotation number. According to the first embodiment, the second storage region 85B stores therein a second total rotation number Y as the second rotation number. The second total rotation number Y is a cumulative rotation number of the photosensitive drum 81 which is the new photosensitive drum and which is in the second state. That is, in the second storage region 85B, the second rotation number y is added to the second total rotation number Y each time the photosensitive drum 81 in the second state rotates once. Incidentally, Y=0 is stored in the second storage region 85B in a case where the photosensitive drum 81 is the new drum.

In this way, the controller 100 increments, in the drum memory 85, the total rotation numbers X, Y by the first rotation number x and the second rotation number y those counted for the predetermined period of time.

For the calculation of the deterioration quantity of the photosensitive drum 81, the controller 100 retrieves the first total rotation number X and the second total rotation number Y in the RAM 102 from the drum memory 85. The controller 100 calculates the total deterioration quantity W of the photosensitive drum 81 on a basis of the first total rotation number X and the second total rotation number Y those stored in the RAM 102.

Specifically, a sum of the product obtained by multiplying the first total rotation number X by a first coefficient "a" and the product obtained by multiplying the second total rotation number Y by a second coefficient "b" is calculated by the controller 100 to obtain the total deterioration quantity W of the photosensitive drum 81 (W=aX+bY). The second coefficient b is smaller than the first coefficient a. Incidentally, the first coefficient a and the second coefficient b are positive values, and are obtained by experimental data prior to delivery of the image forming apparatus 1. The first coefficient a and the second coefficient b are stored in advance in the main memory 110, for example in the EEPROM 104.

The controller 100 is configured to determine the lifetime of the photosensitive drum 81 in a case where the total deterioration quantity W of the photosensitive drum 81 reaches a threshold value. The threshold value is stored in advance in the main memory 110, for example, in the EEPROM 104.

The controller 100 is configured to calculate a remaining lifetime of the photosensitive drum 81 by subtracting the total deterioration quantity W of the photosensitive drum 81 from the lifetime of the photosensitive drum. The calculated remaining lifetime is indicated by a display portion (not illustrated) of the image forming apparatus 1.

Next, one example of processing performed in the controller 100 will be described with reference to the flowchart illustrated in FIGS. 3 and 4. The controller 100 repeatedly performs this processing as long as the image forming apparatus 1 is powered ON.

Figure 3:
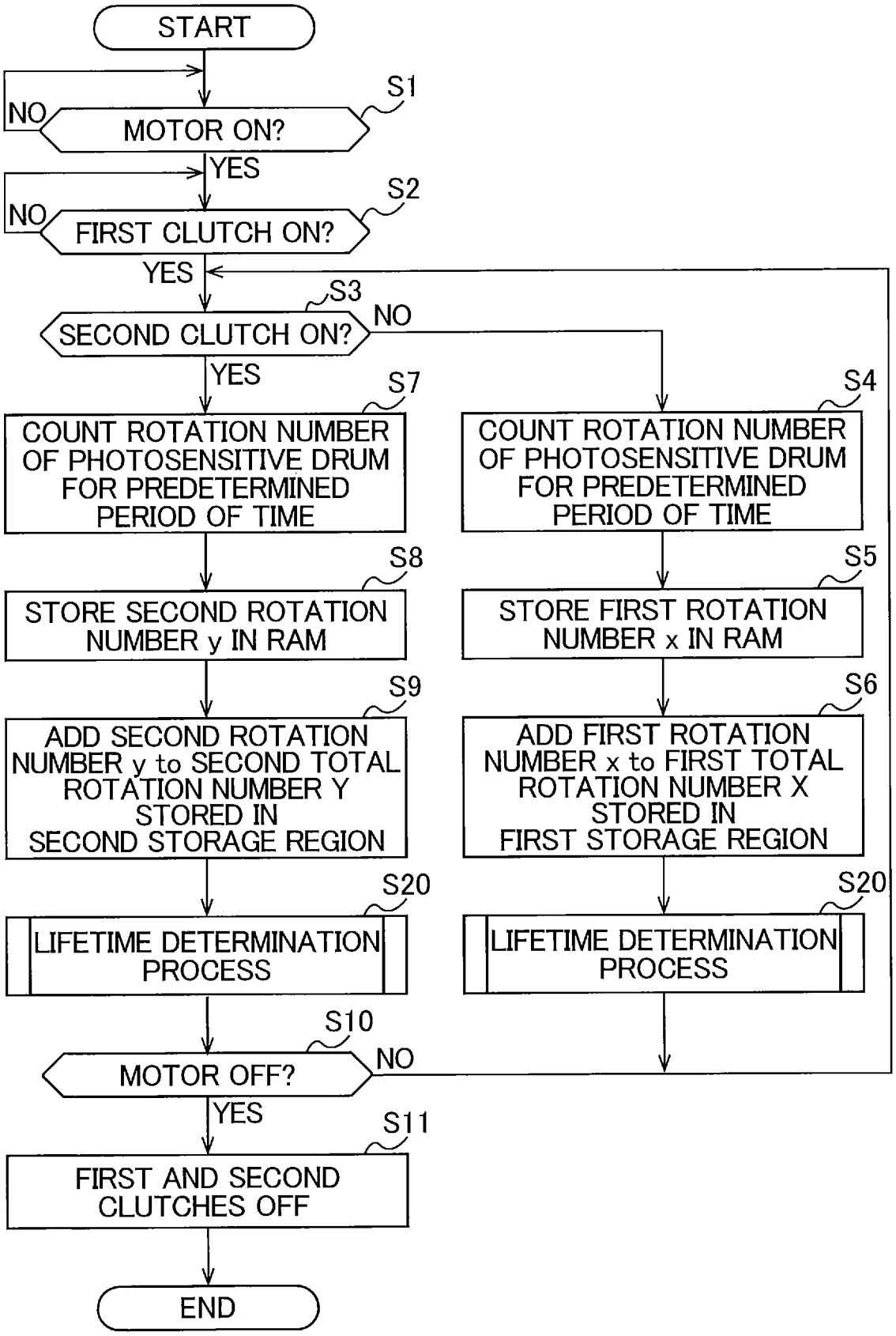
FIG. 3 is a flowchart illustrating a process performed in the controller for storing information in the drum memory in the image forming apparatus according to the first embodiment.

As illustrated in FIG. 3, the controller 100 determines whether the main motor M1 is turned ON (S1). The controller 100 waits until the main motor M1 is turned ON in a case where the controller 100 determines that the main motor M1 is not turned ON (S1: No).

In a case where the controller 100 determines that the main motor M1 is turned ON (S1: Yes), the controller 100 determines whether the first clutch CR1 is in the ON state (S2). In a case where the controller 100 determines that the first clutch CR1 is not in the ON state (S2: No), the controller 100 waits until the CR1 is turned ON, since the photosensitive drum 81 is not rotated. On the other hand, in a case where the controller 100 determines that the first clutch CR1 is in the ON state (S2: Yes), the controller 100 determines whether the second clutch CR2 is in the ON state (S3).

In step S3, in a case where the controller 100 determines that the second clutch CR2 is not in the ON state (S3: No), the controller 100 counts the rotation number of the photosensitive drum 81 for the predetermined period of time (S4). Since the first state is present where the photosensitive drum 81 rotates but the developing roller 91 does not rotate, the controller 100 stores the counted rotation number as the first rotation number x in the RAM 102 (S5).

After the step S5, the controller 100 adds the first rotation number x to the first total rotation number X stored in the first storage region 85A (S6). After the step S6, the controller 100 performs lifetime determination process (S20) described later, and the processing is returned to the step S3.

On the other hand, in the step S3, in a case where the controller 100 determines that the second clutch CR2 is in the ON state (S3: Yes), the controller 100 counts the rotation number of the photosensitive drum 81 for the predetermined period of time (S7). Since the second state is present where the photosensitive drum 81 rotates and the developing roller 91 also rotates, the controller 100 stores the counted rotation number as the second rotation number y in the RAM 102 (S8).

After the step S8, the controller 100 adds the second rotation number y to the second total rotation number Y stored in the second storage region 85B (S9). After the step S9, the controller 100 performs the lifetime determination process (S20) described later, and then, determines whether the motor M should be turned OFF (S10).

In the step S10, in a case where the controller 100 determines that the motor M should not be turned OFF (S10: No), the processing returns to the step S3 since the photosensitive drum 81 continues rotation in the second state. On the other hand, in a case where the controller 100 determines that the motor M should be turned OFF (S10: Yes), the controller 100 permits the first clutch CR1 and the second clutch CR2 to be turned OFF (S11), and the processing is finished.

Next, lifetime determination processing performed in the controller 100 will be described with reference to flowchart illustrated in FIG. 4.

Figure 4:
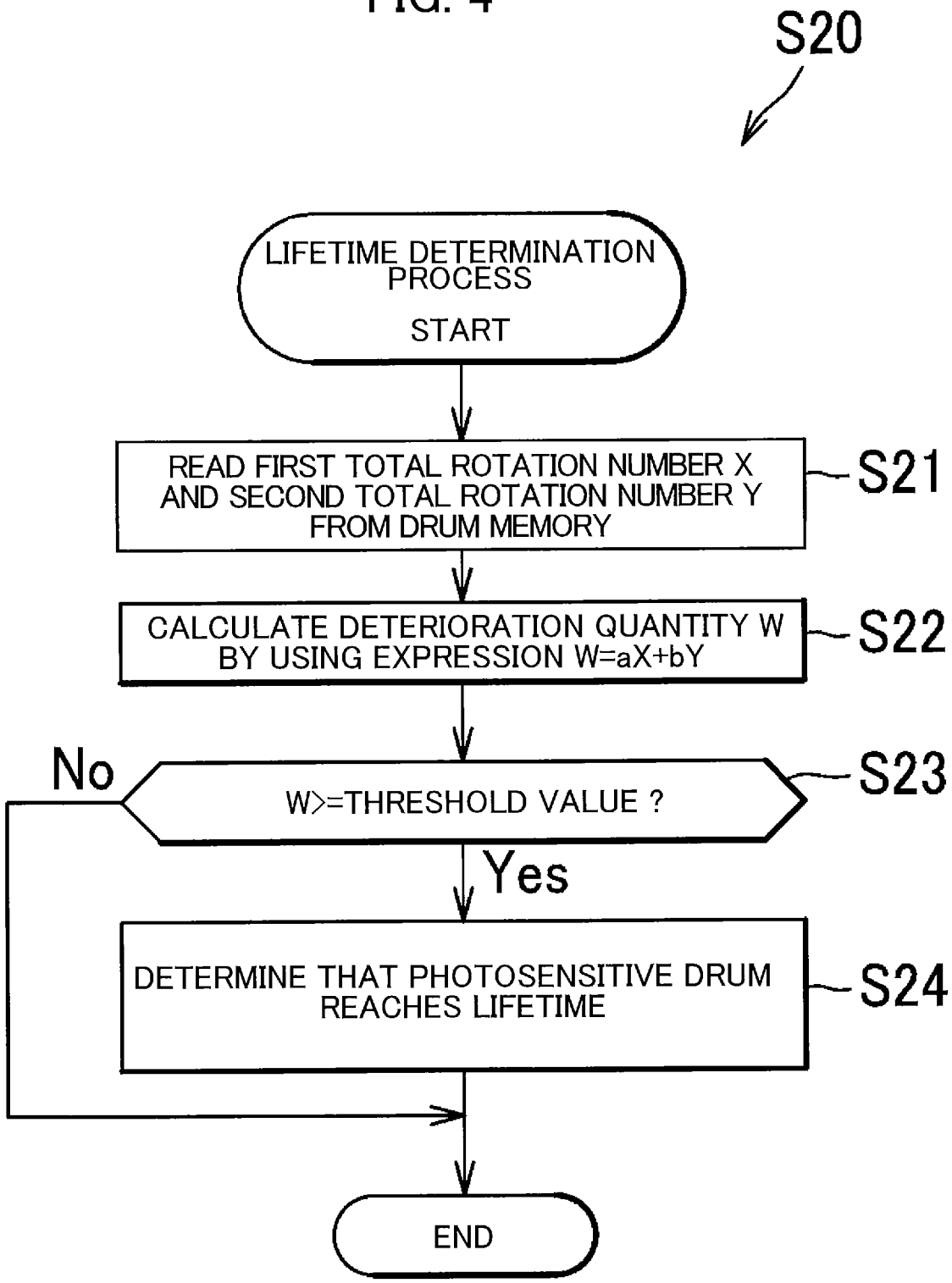
FIG. 4 is a flowchart illustrating a lifetime determination process in the image forming apparatus according to the first embodiment.

As illustrated in FIG. 4, for performing the lifetime determination processing, the controller 100 retrieves the first total rotation number X and the second total rotation number Y in the RAM 102 from the drum memory 85 (S21).

After the step S21, the controller 100 calculates the deterioration quantity W of the photosensitive drum 81, which is the sum of the product obtained by multiplying the first total rotation number X by the first coefficient "a" and the product obtained by multiplying the second total rotation number Y by the second coefficient "b" (W=aX+bY) (S22).

After the step S22, the controller 100 determines whether the calculated total deterioration quantity W is equal to or greater than the threshold value (S23). In a case where the calculated total deterioration quantity W is equal to or greater than the threshold value (S23: Yes), the controller 100 determines that the photosensitive drum 81 reaches the lifetime (S24), and the processing is finished. On the other hand, in a case where the controller 100 determines that the calculated total deterioration quantity W is less than the threshold value (S23: No), the controller 100 determines that the photosensitive drum 81 does not reach the lifetime, and the processing is finished.

The first embodiment described above can exhibit the effects as follows. As described above, the first rotation number and the second rotation number are separately stored in the drum memory 85 of the drum cartridge 8. Here, the first rotation number is the rotation number of the photosensitive drum 81 in the first state where the photosensitive drum 81 rotates but the developing roller 91 is stopped, and the second rotation number is the rotation number of the photosensitive drum 81 in the second state where the photosensitive drum 81 rotates and the developing roller 91 also rotates. Hence, deterioration quantity of the photosensitive drum 81 can be accurately calculated.

In the first state, since the photosensitive drum 81 rotates while the rotation of the developing roller 91 is stopped, deterioration quantity per rotation is greater than that in the second state. In this connection, accurate calculation cannot be attained given that the deterioration quantity of the photosensitive drum 81 in the first state is equal to that in the second state.

Against this, the controller 100 in the image forming apparatus 1 according to the first embodiment calculates the amount of depletion due to the rotation of the photosensitive drum 81 on a basis of the first rotation number in the first state and the second rotation number in the second state. Therefore, accurate calculation with respect to the deterioration quantity of the photosensitive drum 81 can be performed.

Next, an image forming apparatus according to a second embodiment will be described with reference to FIGS. 5 and 6. The second embodiment is different from the first embodiment in that the total deterioration quantity W of the photosensitive drum 81 is stored in the drum memory 85 and in that the total deterioration quantity W of the photosensitive drum 81 and a first correction factor "α" based on the total rotation number Z which is a cumulative rotation number of the developing roller 91 are used for the calculation of the deterioration quantity of the photosensitive drum 81.

The total deterioration quantity W is determined by the accumulation of the deterioration quantity w for a predetermined period of time from a time at which the photosensitive drum 81 is a new drum. The deterioration quantity w for the predetermined period of time is determined by a final product obtained by multiplying a first product by the first correction factor "α", the first product being obtained by multiplying the first rotation number x by the first coefficient "a", and is determined by a final product obtained by multiplying a second product by the first correction factor "α", the second product being obtained by multiplying the second rotation number y by the second coefficient "b" (w=αax, and w=αby)). The deterioration quantity w for the predetermined period of time may be calculated by adding the first product and the second product.

In the second embodiment, the controller 100 is configured to count the rotation number z of the developing roller 91 for the predetermined period of time as well as the first rotation number x and the second rotation number y. The first rotation number x, the second rotation number y, and the rotation number z of the developing roller 91 are sequentially written in the RAM 102.

The total rotation number Z of the developing roller 91 is stored in the developing memory 95. The total rotation number Z of the developing roller 91 is the cumulative rotation number starting from a time at which the developing roller 91 is a new roller. That is, in the developing memory 95, the rotation number z for the predetermined period of time is added to the total rotation number Z each time the developing roller 91 rotates once in the predetermined period of time. Incidentally, Z=0 is stored in the developing memory 95 in a case where the developing roller 91 is the new roller. In this way, the controller 100 increments, in the developing memory 95, the total rotation number Z by the rotation number z written in the RAM 102.

In the second embodiment, total deterioration quantity W is stored in the drum memory 85. In a case where the photosensitive drum 81 is a new drum, W=0 is stored in the drum memory 85.

The controller 100 is configured to calculate a deterioration quantity w for a predetermined period of time and add the calculated deterioration quantity w to the total deterioration quantity W in case of rotation of the photosensitive drum 81 for the predetermined period of time. As such, in the second embodiment, the drum memory 85 stores therein the total deterioration quantity W.

The controller 100 is configured to read the total deterioration quantity W from the drum memory 85 and write the total deterioration quantity W in the RAM 102 to calculate the deterioration quantity w for the predetermined period of time. Further, the controller 100 is configured to read the total deterioration quantity Z of the developing roller 91 from the developing memory 95 and write the total deterioration quantity Z in the RAM 102. The controller 100 is configured to determine the first correction factor "α" on a basis of the total deterioration quantity W and the total rotation amount Z those read from the RAM 102.

The first correction factor "α" is determined to be greater value as the total deterioration quantity W is increased, and further, is determined to be smaller value as the total rotation number Z which is the cumulative rotation number of the developing roller 91 from the time at which the developing roller 91 is the new roller ($\alpha=T+dW-cZ$). "T", "d" and "c" are positive values and are determined by experimental data prior to delivery of the image forming apparatus 1.

Next, one example of processing performed in the controller 100 according to the second embodiment will be described with reference to flowchart illustrated in FIG. 5.

Incidentally, like step numbers are designated by the same step numbers as those illustrated in FIG. 3 to avoid duplicating description. That is, the steps S1 through S5 in the first embodiment are also performed in the second embodiment.

Figure 5:
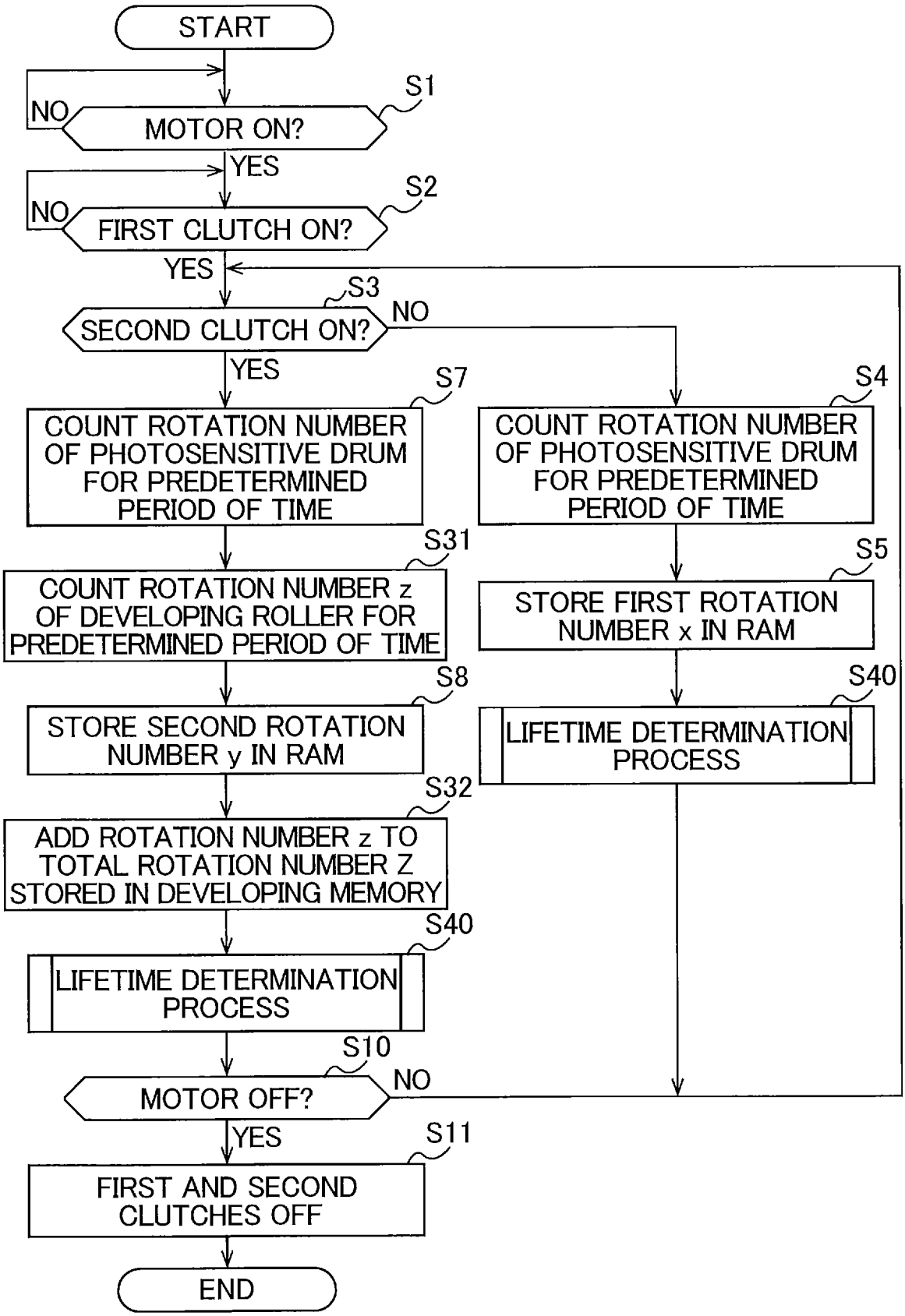
FIG. 5 is a flowchart illustrating a process performed in the controller for storing information in the drum memory in an image forming apparatus according to a second embodiment.

As illustrated in FIG. 5, after the step S5, the controller 100 performs lifetime determination process (S40) described later, and the processing is returned to the step S3.

In step S3, in a case where the controller 100 determines that the second clutch CR2 is in the ON state (S3: Yes), the controller 100 counts the rotation number of the photosensitive drum 81 for the predetermined period of time (S7). Further, concurrently with the step S7, the controller 100 counts the rotation number z of the developing roller 91 for the predetermined period of time (S31).

After the steps S7 and S31, since the second state is present where the photosensitive drum 81 rotates and the developing roller 91 also rotates, the controller 100 stores the counted rotation number as the second rotation number y in the RAM 102 (S8). Further, the controller 100 adds the rotation number z of the developing roller 91 rotating for the predetermined period of time to the total rotation number Z stored in the developing memory 95 (S32).

After the step S32, the controller 100 performs the lifetime determination process (S40) described later, and determines whether the motor M should be turned OFF (S10).

In the step S10, in a case where the controller 100 determines that the motor M should not be turned OFF (S10: No), the processing returns to the step S3 since the photosensitive drum 81 continues rotation in the second state. On the other hand, in a case where the controller 100 determines that the motor M should be turned OFF (S10: Yes), the controller 100 permits the first clutch CR1 and the second clutch CR2 to be turned OFF (S11), and the processing is finished.

Next, lifetime determination processing performed in the controller 100 according to the second embodiment will be described with reference to flowchart illustrated in FIG. 6.

Figure 6:
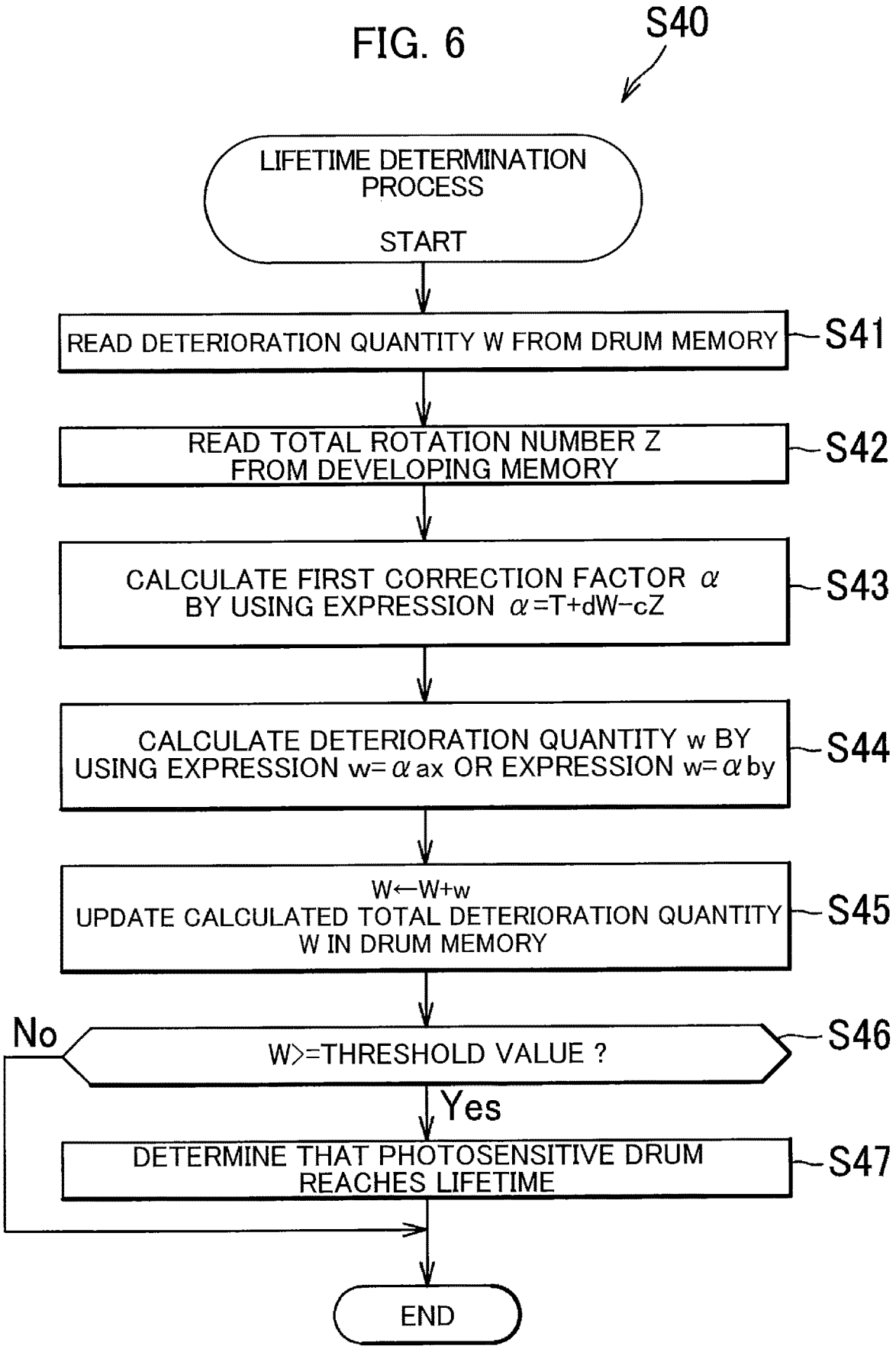
FIG. 6 is a flowchart illustrating a lifetime determination process in the image forming apparatus according to the second embodiment.

As illustrated in FIG. 6, for performing the lifetime determination processing, the controller 100 reads out the total deterioration quantity W from the drum memory 85 and stores the total deterioration quantity W in the RAM 102 (S41). Further, the controller 100 reads out the total rotation number Z of the developing roller 91 from the developing memory 95 and stores the total rotation number Z in the RAM 102 (S42).

After the step S42, the controller 100 calculates the first correction factor "α" on a basis of the equation "$\alpha=T+dW-cZ$" (S43).

After the step S43, the controller 100 calculates the deterioration quantity w of the photosensitive drum 81 for the predetermined period of time using the equation "$w=\alpha ax$" or "$w=\alpha by$" (S44).

After the step S44, the controller 100 updates the total deterioration quantity W by adding the deterioration quantity w for the predetermined period of time calculated in the step S44 to the total deterioration quantity W stored in the drum memory 85 (S45).

After the step S45, the controller 100 determines whether the total deterioration quantity W stored in the drum memory 85 is equal to or greater than the threshold value (S46). In a case where the calculated total deterioration quantity W is equal to or greater than the threshold value (S46: Yes), the controller 100 determines that the photosensitive drum 81 reaches the lifetime (S47), and the processing is finished. On the other hand, in a case where the controller 100 determines that the calculated total deterioration quantity W is less than the threshold value (S46: No), the controller 100 determines that the photosensitive drum 81 does not reach the lifetime, and the processing is finished.

Degradation or wearing of the photosensitive drum 81 may be promoted as the total deterioration quantity W of the photosensitive drum 81 is increased. Further, the degradation or wearing of the photosensitive drum 81 may be reduced as the total rotation number of the developing roller 91 increases.

According to the second embodiment, deterioration quantity is calculated by multiplying the first correction factor "α" derived from the total deterioration quantity W of the photosensitive drum 81 and the total rotation number Z of the developing roller 91 by the product obtained by multiplying the first rotation number x by the first coefficient "a", and by multiplying the first correction factor "α" by the product obtained by multiplying the second rotation number y by the second coefficient "b". Therefore, deterioration quantity of the photosensitive drum 81 can be accurately calculated.

Various modifications are conceivable. For example, in the second embodiment, the first correction factor "α" is determined on the basis of the total deterioration quantity W and the total rotation number Z of the developing roller 91. However, the first correction factor "α" may be determined by another fashion.

For example, a correction factor (second correction factor β) may be determined by the total deterioration quantity W. Specifically, the deterioration quantity w for the predetermined period of time may be calculated by multiplying the second correction factor β by a sum of a product obtained by multiplying the first rotation number by the first coefficient and a product obtained by multiplying the second rotation number by the second coefficient which is smaller than the first coefficient, that is, $w=\beta(ax+by)$. Here, the second correction factor β is determined to be greater value as the total deterioration quantity W increases.

With this configuration, deterioration quantity of the photosensitive drum 81 can be obtained with high accuracy because of the calculation through the multiplication of the second correction factor β based on the total deterioration quantity W of the photosensitive drum 81.

Further, the correction factor (third correction factor γ) may be determined on a basis of the total rotation number Z of the developing roller 91. Specifically, the deterioration quantity w for the predetermined period of time may be calculated by multiplying the third correction factor γ by a sum of a product obtained by multiplying the first rotation number by the first coefficient and a product obtained by multiplying the second rotation number by the second coefficient which is smaller than the first coefficient, that is, $w=\gamma(ax+by)$. Here, the third correction factor γ is determined to be smaller value as the total rotation number Z increases.

The total rotation number Z is the cumulative rotation number z of the developing roller 91 from the time at which the developing roller 91 is the new roller.

With this configuration, deterioration quantity of the photosensitive drum 81 can be obtained with high accuracy because of the calculation through the multiplication of the third correction factor γ based on the total rotation number Z of the developing roller 91.

Further, in the second embodiment, the drum memory 85 is configured to store the total deterioration quantity W of the photosensitive drum 81. However, the drum memory 85 may be configured to store the deterioration quantity w of the photosensitive drum 81 for the predetermined period of time. In the latter case, the controller 100 may sequentially permit the drum memory 85 to store the deterioration quantity w for the predetermined period of time starting from the timing at which the drum memory 85 is the new drum. Further, the controller 100 may retrieve all deterioration quantities w in the RAM 102 from the drum memory 85 to calculate the total deterioration quantity W.

Further, the drum memory 85 may be configured to store therein the total deterioration quantity W and the deterioration quantity w for the predetermined period of time of the photosensitive drum 81.

Further, in the above-described embodiments, the developing cartridge 9 is attachable to and detachable from the drum cartridge 8. However, a developing cartridge and a drum cartridge may be attached to and detached from the housing independently of each other.

Further, in the above-described embodiments, the image forming apparatus 1 is the monochromatic laser printer. However, a color laser printer, a copying machine and a multi-function peripheral are also available as the image forming apparatus.

Further, in the above-described embodiments, the drum cartridge 8 includes a single photosensitive drum 81, and the developing cartridge 9 corresponding to the photosensitive drum 81 is attachable to and detachable from the drum cartridge 8. However, another configuration is conceivable. For example, a drum cartridge may include a plurality of photosensitive drums, and a plurality of developing cartridges corresponding to the plurality of photosensitive drums may be attachable to and detachable from the drum cartridge. In the latter case, the drum cartridge may be a drawer configured to be pulled out of the housing.

Further, in the above-described embodiment, the drum cartridge 8 is configured to permit the developing cartridge 9 including the developing roller 91 to be attachable to and detachable from the drum cartridge 8. However, a drum cartridge may be configured to permit a toner cartridge excluding the developing roller to be attachable to and detachable from the drum cartridge. In the latter case, the drum cartridge may include the developing roller and the photosensitive drum, and the toner cartridge does not include the developing roller but include a toner accommodating portion for accommodating therein toner.

Further, in the above-described embodiments, the developing cartridge 9 is attachable to and detachable from the drum cartridge 8, and the drum cartridge 8 to which the developing cartridge 9 is attached is attachable to and detachable from the housing 2. However, a developing cartridge and a drum cartridge may be attachable to and detachable from the housing independently of each other. Further, a drum cartridge of an integrated type may be provided in which a developing cartridge is un-separable from the drum cartridge and such drum cartridge may be attachable to and detachable from the housing. In the latter case, the drum cartridge may include a toner accommodating portion for accommodating therein toner, a developing roller, and a photosensitive drum.

While the description has been made in detail with reference to the specific embodiments and modifications, it would be apparent to those skilled in the art that various changes and modifications may be made thereto without departing from the scope of the disclosure. Further, components appearing in the embodiments and modifications may be suitably selected and combined together avoiding conflicting combination.

What is claimed is:

1. An image forming apparatus comprising:

a motor;

a photosensitive drum;

a first clutch configured to transmit a driving force of the motor to the photosensitive drum, the first clutch being switchable between a state for allowing the photosensitive drum to rotate and a state for stopping rotation of the photosensitive drum;

a developing roller;

a second clutch configured to transmit the driving force of the motor to the developing roller, the second clutch being switchable between a state for allowing the developing roller to rotate and a state for stopping rotation of the developing roller;

a main memory; and a controller configured to perform:

storing a first rotation number and a second rotation number in the main memory, the first rotation number being the rotation number of the photosensitive drum rotated in a first state where the first clutch is in the state for allowing the photosensitive drum to rotate and the second clutch is in the state for stopping rotation of the developing roller, the second rotation number being the rotation number of the photosensitive drum rotated in a second state where the first clutch is in the state for allowing the photosensitive drum to rotate and the second clutch is in the state for allowing the developing roller to rotate; and in a case where the photosensitive drum rotates, determining a total deterioration quantity of the photosensitive drum which is a cumulative deterioration quantity of the photosensitive drum based on the first rotation number and the second rotation number.

2. The image forming apparatus according to claim 1, wherein the controller is configured to further perform:

calculating a deterioration quantity of the photosensitive drum by adding a first product obtained by multiplying the first rotation number by a first coefficient and a second product obtained by multiplying the second rotation number by a second coefficient which is smaller than the first coefficient; and calculating the total deterioration quantity by cumulating the deterioration quantity from a time at which the photosensitive drum is a new one.

3. The image forming apparatus according to claim 2, wherein the controller is configured to further perform:

determining a first correction factor so as to be a greater value as the total deterioration quantity is increased and to be a smaller value as a total rotation number which is a cumulative rotation number of the developing roller is increased; and calculating the deterioration quantity by multiplying the first correction factor by the first product, and by multiplying the first correction factor by the second product.

4. The image forming apparatus according to claim 2, wherein the controller is configured to further perform:

determining a second correction factor so as to be a greater value as the total deterioration quantity is increased; and calculating the deterioration quantity by multiplying the second correction factor by the first product, and by multiplying the second correction factor by the second product.

5. The image forming apparatus according to claim 2, wherein the controller is configured to further perform:

determining a third correction factor so as to be smaller value as a total rotation number which is a cumulative rotation number of the developing roller is increased; and calculating the deterioration quantity by multiplying the third correction factor by the first product, and by multiplying the third correction factor by the second product.

6. The image forming apparatus according to claim 2, wherein a drum cartridge including the photosensitive drum and a drum memory is attachable to and detachable from the image forming apparatus, wherein the controller is configured to further perform:

storing the total deterioration quantity in the drum memory; and in the case where the photosensitive drum rotates, storing, in the drum memory, a new total deterioration quantity calculated by adding a most recently calculated deterioration quantity to the total deterioration quantity which is stored in the drum memory.

7. The image forming apparatus according to claim 6, wherein the drum memory stores a lifetime of the photosensitive drum therein, and wherein the controller is configured to further perform:

calculating a remaining lifetime of the photosensitive drum by subtracting the total deterioration quantity of the photosensitive drum from the lifetime stored in the drum memory.

8. The image forming apparatus according to claim 7, wherein the controller is configured to further perform:

determining that the photosensitive drum reaches the lifetime of the photosensitive drum in a case where the total deterioration quantity of the photosensitive drum reaches a threshold value.

9. The image forming apparatus according to claim 1, wherein the photosensitive drum rotates about a first axis extending in an axial direction of the photosensitive drum, and wherein the developing roller rotates about a second axis extending in the axial direction.

10. A drum cartridge for use with an image forming apparatus, the image forming apparatus having a motor, a first clutch, and a second clutch, the drum cartridge comprising:

a photosensitive drum that rotates in a state where the first clutch is in a state for allowing the photosensitive drum to rotate by transmitting a driving force of the motor to the photosensitive drum and that is stopped in a state where the first clutch is in a state for stopping rotation of the photosensitive drum by not transmitting the driving force of the motor to the photosensitive drum;

a developing roller that rotates in a state where the second clutch is in a state for allowing the developing roller to rotate by transmitting a driving force of the motor to the developing roller and that is stopped in a state where the second clutch is in a state for stopping rotation of the developing roller by not transmitting the driving force of the motor to the developing roller; and a drum memory including:

a first storage region storing a first rotation number which is the rotation number of the photosensitive drum rotated in a first state where the first clutch is in the state for allowing the photosensitive drum to rotate and the second clutch is in the state for stopping rotation of the developing roller; and a second storage region storing a second rotation number which is the rotation number of the photosensitive drum rotated in a second state where the first clutch is in the state for allowing the photosensitive drum to rotate and the second clutch is in the state for allowing the developing roller to rotate.

11. The drum cartridge according to claim 10, wherein a total deterioration quantity which is a cumulative deterioration quantity of the photosensitive drum is determined based on the first rotation number and the second rotation number.

12. The drum cartridge according to claim 11, wherein a deterioration quantity of the photosensitive drum is determined by adding a first product obtained by multiplying the first rotation number by a first coefficient and a second product obtained by multiplying the second rotation number by a second coefficient which is smaller than the first coefficient, and wherein the total deterioration quantity is determined by cumulating the deterioration quantity from a time at which the photosensitive drum is a new one.

13. The drum cartridge according to claim 11, wherein a first correction factor is determined so as to be a greater value as the total deterioration quantity is increased and to be a smaller value as a total rotation number which is a cumulative rotation number of the developing roller is increased from a time at which the developing roller is a new one, and wherein a deterioration quantity of the photosensitive drum is determined by multiplying the first correction factor by a first product obtained by multiplying the first rotation number by a first coefficient, and by multiplying the first correction factor by a second product obtained by multiplying the second rotation number by a second coefficient which is smaller than the first coefficient.

14. The drum cartridge according to claim 11, wherein a second correction factor is determined so as to be a greater value as the total deterioration quantity is increased, and wherein a deterioration quantity of the photosensitive drum is determined by multiplying the second correction factor by a first product obtained by multiplying the first rotation number by a first coefficient, and by multiplying the first correction factor by a second product obtained by multiplying the second rotation number by a second coefficient which is smaller than the first coefficient.

15. The drum cartridge according to claim 11, wherein a third correction factor is determined so as to be a smaller value as a total rotation number which is the cumulative rotation number of the developing roller is increased, and wherein a deterioration quantity of the photosensitive drum is determined by multiplying the third correction factor by a first product obtained by multiplying the first rotation number by a first coefficient, and by multiplying the third correction factor by a second product obtained by multiplying the second rotation number by a second coefficient which is smaller than the first coefficient.

16. The drum cartridge according to claim 10, wherein the photosensitive drum rotates about a first axis extending in an axial direction of the photosensitive drum, and wherein the developing roller rotates about a second axis extending in the axial direction.

17. The drum cartridge according to claim 10, wherein the drum cartridge is for use with a developing cartridge including the developing roller, and wherein the developing cartridge is attachable to and detachable from the drum cartridge.

18. The drum cartridge according to claim 10, further comprising a plurality of the photosensitive drums, and wherein the drum cartridge is a drawer configured to be pulled out of the image forming apparatus.

19. A drum cartridge for use with an image forming apparatus, the image forming apparatus having a motor, a first clutch, and a second clutch, the drum cartridge comprising:

a photosensitive drum that rotates in a state where the first clutch is in a state for allowing the photosensitive drum to rotate by transmitting a driving force of the motor to the photosensitive drum and that is stopped in a state where the first clutch is in a state for stopping rotation of the photosensitive drum by not transmitting the driving force of the motor to the photosensitive drum;

a developing roller that rotates in a state where the second clutch is in a state for allowing the developing roller to rotate by transmitting a driving force of the motor to the developing roller and that is stopped in a state where the second clutch is in a state for stopping rotation of the developing roller by not transmitting the driving force of the motor to the developing roller; and a drum memory storing a deterioration quantity determined based on a first rotation number and a second rotation number, the first rotation number being the rotation number of the photosensitive drum rotated in a first state where the first clutch is in the state for allowing the photosensitive drum to rotate and the second clutch is in the state for stopping rotation of the developing roller, the second rotation number being the rotation number of the photosensitive drum rotated in a second state where the first clutch is in the state for allowing the photosensitive drum to rotate and the second clutch is in the state for allowing the developing roller to rotate.

20. The drum cartridge according to claim 19, wherein a total deterioration quantity obtained by cumulating the deterioration quantity for a period of time from a time at which the photosensitive drum is a new one, and wherein the drum memory stores the total deterioration quantity.

21. The drum cartridge according to claim 20, wherein the deterioration quantity is determined by adding a first product obtained by multiplying the first rotation number by a first coefficient and a second product obtained by multiplying the second rotation number by a second coefficient which is smaller than the first coefficient, and wherein the total deterioration quantity is determined by cumulating the deterioration quantity from the time at which the photosensitive drum is a new one.

22. The drum cartridge according to claim 20, wherein a first correction factor is determined so as to be a greater value as the total deterioration quantity is increased and to be a smaller value as a total rotation number which is a cumulative rotation number of the developing roller is increased from a time at which the developing roller is a new one, and wherein a deterioration quantity of the photosensitive drum is determined by multiplying the first correction factor by a first product obtained by multiplying the first rotation number by a first coefficient, and by multiplying the first correction factor by a second product obtained by multiplying the second rotation number by a second coefficient which is smaller than the first coefficient.

23. The drum cartridge according to claim 20, wherein a second correction factor is determined so as to be a greater value as the total deterioration quantity is increased, and wherein a deterioration quantity of the photosensitive drum is determined by multiplying the second correction factor by a first product obtained by multiplying the first rotation number by a first coefficient, and by multiplying the first correction factor by a second product obtained by multiplying the second rotation number by a second coefficient which is smaller than the first coefficient.

24. The drum cartridge according to claim 20, wherein a third correction factor is determined so as to be a smaller value as a total rotation number which is the cumulative rotation number of the developing roller is increased, and wherein a deterioration quantity of the photosensitive drum is determined by multiplying the third correction factor by a first product obtained by multiplying the first rotation number by a first coefficient, and by multiplying the third correction factor by a second product obtained by multiplying the second rotation number by a second coefficient which is smaller than the first coefficient.

25. The drum cartridge according to claim 19, wherein a total deterioration quantity is obtained by cumulating the deterioration quantity for a period of time from a time at which the photosensitive drum is a new one, and wherein the drum memory sequentially stores the deterioration quantity for a period of time from the time at which the photosensitive drum is a new one.

26. The drum cartridge according to claim 19, wherein the photosensitive drum rotates about a first axis extending in an axial direction of the photosensitive drum, and wherein the developing roller rotates about a second axis extending in the axial direction.

27. The drum cartridge according to claim 19, wherein the drum cartridge is for use with a developing cartridge including the developing roller, and wherein the developing cartridge is attachable to and detachable from the drum cartridge.

28. The drum cartridge according to claim 19, further comprising a plurality of the photosensitive drums, and wherein the drum cartridge is a drawer configured to be pulled out of the image forming apparatus.

* * * * *